United States Patent [19]

Miura

[11] Patent Number: 4,512,169

[45] Date of Patent: Apr. 23, 1985

[54] AUTOMATIC PLATE THICKNESS CONTROL DEVICE

[75] Inventor: Keiichi Miura, Hyogo, Japan

[73] Assignee: Mitsubishi Denki Kabushiki Kaisha, Tokyo, Japan

[21] Appl. No.: 466,469

[22] Filed: Feb. 15, 1983

[30] Foreign Application Priority Data

Feb. 15, 1982 [JP] Japan ..... 57-23905

[51] Int. Cl.[3] ..... B21B 37/12

[52] U.S. Cl. ..... 72/16; 72/8

[58] Field of Search ..... 72/8, 16, 20, 366

[56] References Cited

FOREIGN PATENT DOCUMENTS 64918 5/1980 Japan ..... 72/16

*Primary Examiner*—Francis S. Husar
*Assistant Examiner*—Jorji M. Griffin
*Attorney, Agent, or Firm*—Sughrue, Mion, Zinn, Macpeak, and Seas

[57] ABSTRACT

A thickness control device and method for maintaining the thickness of the rolled material which is passed between the rollers of a rolling mill, in which the rollers above and below the rolling material are rotated at different speeds $V_H$ and $V_L$. A variation in rolling material thickness is detected and expressed in terms of a change in rolling load WF.

The differential peripheral speed rate $X\left(X = \frac{V_H - V_L}{V_H}\right)$ is also detected. The change in rolling load ΔF and the differential peripheral speed rate X are used to derive the change in differential speed rate ΔX which would cancel out the variation in rolling material thickness. This correcting differential peripheral speed rate ΔX is then utilized to change the velocities $V_H$ and $V_L$ of the upper and lower rollers, respectively, such that the thickness variation is eliminated without changing the speed of the rolled material.

6 Claims, 4 Drawing Figures

3
54
45
42
41
49°
S
41
42
50°
52
PG
52
PG
43
M
ASR
ASR
44
$V_L$
$V_H$
$X = \frac{V_H - V_L}{V_H}$
53
X
TIMING CALCU.
51
46
$F_0$
ΔF
$\left(\frac{\partial F}{\partial X}\right)^{-1}$
$X_0$
X
47
ΔX
48
55
$V_{OH}$
$V_{OL}$

AUTOMATIC PLATE THICKNESS CONTROL DEVICE

BACKGROUND OF THE INVENTION

This invention relates generally to a rolling mill in which the upper and lower rolling rolls thereof are individually driven, and more particularly, to a novel differential peripheral speed rolling-type automatic plate thickness control device for such a rolling mill, in which the thickness of the plate is controlled by adjusting the difference in speed between the upper and lower rolling rolls.

In general, in a rolling mill such as a plate mill or a hot strip mill, the material thickness on the output side of the mill varies as a function of both the variation in the plastic deformation of the rolling material and the elastic deformation of the rolling mill (such as the elongation thereof). This variation in material thickness occurs even if the roll gap opening of the rolling mill is maintained at a constant value. FIG. 1 is a graphical representation of both the plastic deformation characteristic of a material and the elastic deformation characteristic of a rolling mill. In FIG. 1, curves $P_1$ and $P_2$ are typical plastic deformation curves of rolling material, and curves $M_1$ and $M_2$ are typical rolling mill elastic deformation curves.

The plastic deformation characteristic of a rolling material depends upon the input material thickness H, the output material thickness h, an average deformation resistance k and a material plate width W, or $$F=f(H,h,k,W) \quad (1)$$

In FIG. 1, this relationship is shown by curves M and $M_2$. Thus, the input plate thickness is $H_1$, the plastic curve is $P_1$ and the rolling mill elastic curve is $M_1$. If these values are held constant, and the roll gap opening is $S_1$, then the rolling load is $F_1$ and the output plate thickness is $h_1$ (defining the operating point (1)).

If, at a time instant 2 until which the rolling has been advanced, the input side plate thickness is changed to $H_2$ ($H_1<H_2$) and the other variables are maintained constant, the plastic curve changes from $P_1$ to $P_2$. As a result, the rolling load increases to $F_2$ ($F_1<F_2$) and the output material thickness increases to $h_2$ with the elongation of the rolling mill (defining the operating point (2)).

As is apparent from the above description, if the variation in the plastic characteristic of a rolling material is left uncontrolled, it is impossible to produce series of plates of uniform thickness. For manufacturing reasons, it is necessary to employ means for making the output material thickness constant. Heretofore, an Automatic Gauge Control proposed by British Iron & Steel Research Assn. (BISRA AGC) has been employed for controlling the output plate thickness. The BISR AGC is a method of correcting the roll opening so that the elongation of the rolling mill due to a variation in rolling load is cancelled out. The operating principle of the BISRA AGC is as follows:

If the elastic characteristic of a rolling mill can be approximated by a straight line, and the inclination angle of the straight line (hereinafter referred to as "a mill constant", when applicable) is represented by M, then the rolling mill output plate thickness h can be expresed by the equation:

$$h=S+F/M \quad (2)$$

where h is the material thickness (mm) at the output of the rolling mill, S is the initial roll gap degree (mm), F is the rolling load (ton), and M is the mill constant (ton/mm).

From equation (2), the variation of the output side plate thickness can be expressed as:

$$\Delta h=\Delta S+\Delta F/M \quad (3)$$

Accordingly, the variation in rolled thicknesses can be reduced by correcting the roll opening degree:

$$\Delta S=-\Delta F/M \quad (4)$$

FIG. 2 is a block diagram showing a conventional BISRA AGC. In FIG. 2, reference numeral 1 designates the work rolls of a rolling mill which is supported by the back-up rolls 2. A depressing screw 3 imparts a compressive force on both back-up rolls 2 and work rolls 1. The screw 3 is threadingly engaged to the rolling mill housing 4. A depressing motor 5 adjusts the roll opening degree by turning screw 3. A roll opening degree automatic positioning device (hereinafter referred to as "an APC device"). A roll opening degree detector 7 and a load cell 8 detect the roll opening degree and the rolling load, respectively. A memory device 9 and an arithmetic block 10 for calculating elongations of the rolling mill receive input signals from load cell 8. Finally, 11 denotes a tuning factor setting device, and S denotes a material under rolling.

The operation of the above-described circuitry will now be described. When the material S is fed through the rolling mill housing 4, the instantaneous rolling load Fo is stored in the memory device 9, and the BISRA AGC is initiated. As the work material is advanced through housing 4, the variations in rolling load F are detected as a function of the stored value Fo, and equation (4) is calculated in the elongation calculating block 10. The output of the calculating block 10 is applied (through tuning factor device 11) as a command value to the APC device 6.

As a result, the rolling mill roll opening degree is corrected as a function of operating point (3) in FIG. 1. The tuning factor (11) in FIG. 2 is a constant which determines the degree to which the elongation of the rolling mill is corrected. The tuning factor is set in a range of $0\leqq\alpha\leqq1$, where $\alpha=1$ means that the elongation is corrected 100% and $\alpha=0$ means that the AGC is not operated.

The conventional BISRA AGC, designed as described above, suffers from a drawback in that the operation of the AGC may accelerate the rolling load variation. Referring to FIG. 1, the rolling load variation $\Delta F_2=F_2-F_1$ when the AGC is not operated, and when the AGC is operated, the rolling load variation $\Delta F_3=F_3-F_1$, such that $|\Delta F_2|<|\Delta F_3|$ (i.e., the change in force is enhanced during AGC operations). Further, as the rolling load varies, the deflection of the rolling rolls varies, as a result of the flatness of the product is varied; that is, the quality (in the direction of plate width) of the product is degraded. Accordingly, in a conventional hot strip mill, it is often impossible to apply the BISRA AGC of the prior art to thin and wide strips. Also, in the case of a conventional thick plate mill, it is occasionally necessary to add a special pass under low pressure called a "shape correcting pass" after the final AGC pass.

The ratio of (a) the rolling load variation $\Delta F_3$ at the BISRA AGC (with the tuning factor $\alpha$ being equal to (1) to (b) the rolling load variation $\Delta F_2$ provided when the AGC is not operated, can be expressed as:

$$\frac{\Delta F_3}{\Delta F_2} = \frac{M + Q}{M} \tag{5}$$

where, M is the mill constant (ton/mm), and Q is the elastic constant (ton/mm), i.e., the inclination of the plastic curve near the operating point.

Thus, in the case of an ordinary hot strip mill final stand, wtih a material having a strip width of 1500 mm and a thickness of 1.6 mm, and where Q=3000 tons/mm and M=600 tons/mm approximately, the ratio $\Delta F_3/\Delta F_2 \simeq 6$. When the AGC is operated with $\alpha=1$ under the above-described conditions, the rolling load variation is about 300 tons at the skid mark portion (i.e., where the wavy edges are formed).

Another drawback of the conventional BISRA AGC is as follows: normally, the BISRA AGC should have a mill (elastic) constant as a "model" for the calculation of mill elongation (as is apparent from FIG. 2). However, since the mill constant M is dependent on such factors as material width, plate thickness, roll diameter and rolling force, the accuracy of the estimated mill constant is limited, and accordingly, the improvement of the accuracy of AGC is also limited.

SUMMARY OF INVENTION

An object of this invention is to eliminate the above-described drawbacks accompanying a conventional BISRA AGC. More specifically, an object of the invention is to eliminate the error in mill constant estimation and to reduce the differences in rolling load variations during AGC operations.

The foregoing and other objects of the present invention are realized by automatically controlling the speed of work rolls such that the top rolls rotate at a different speed from the bottom rolls. This speed difference regulates the rolling load such that the rolling accuracy is improved.

BRIEF DESCRIPTION OF THE DRAWINGS

The structure and functions of the present invention will become more apparent upon a detailed description of the preferred embodiment thereof. In the description to follow, reference will be made to the appended drawings, in which.

DESCRIPTION OF THE PREFERRED EMBODIMENT

Control of a rolling load giving a speed difference to the upper and lower work rolls during rolling will now be described with reference to FIG. 3.

Figure 1:
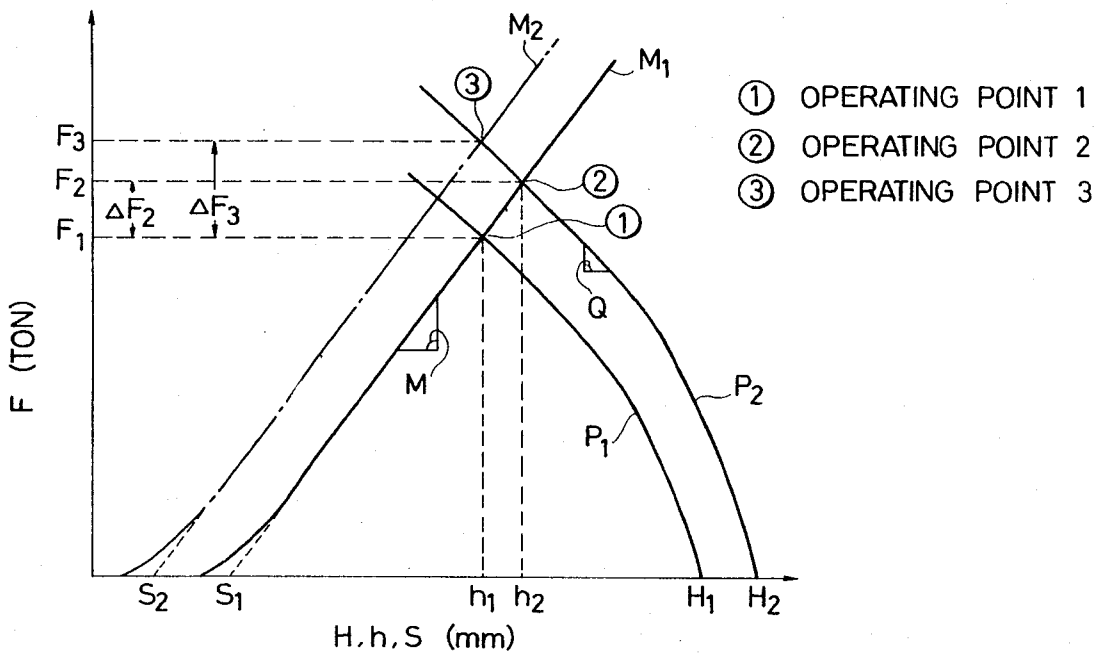
FIG. 1 is a graphical representation of the relationships between the plastic deformation characteristics of materials and the elastic deformation characteristics of rolling mills.
Figure 2:
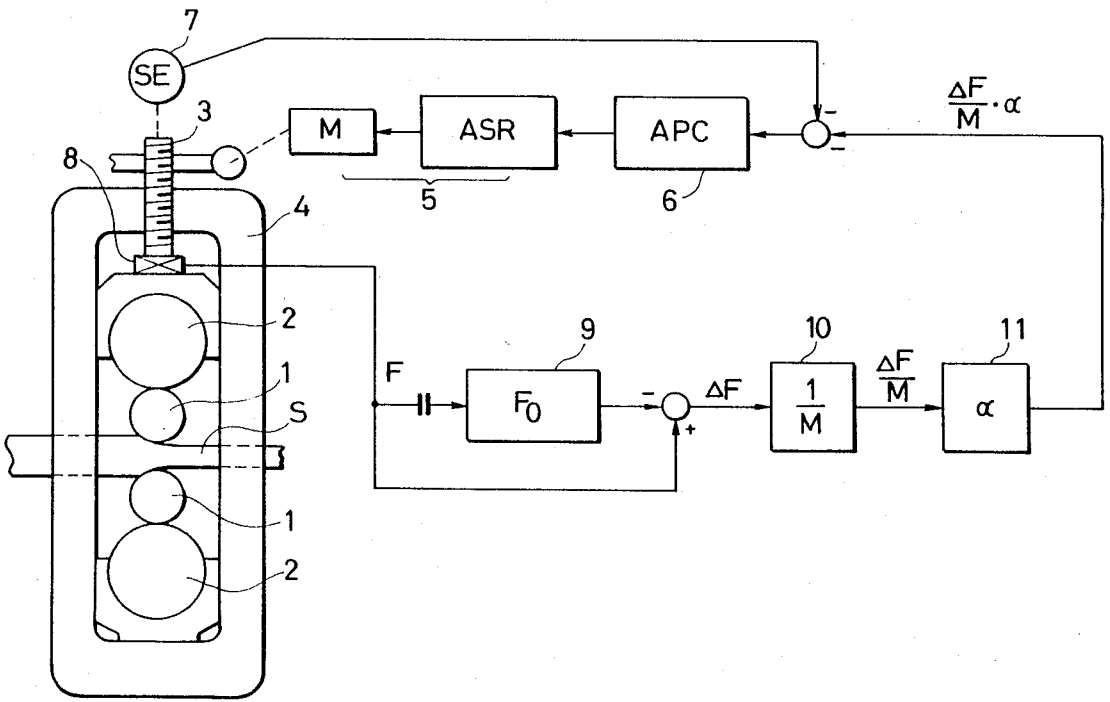
FIG. 2 PRIOR ART
FIG. 2 is a block diagram showing a conventional BISRA AGC.
Figure 3:
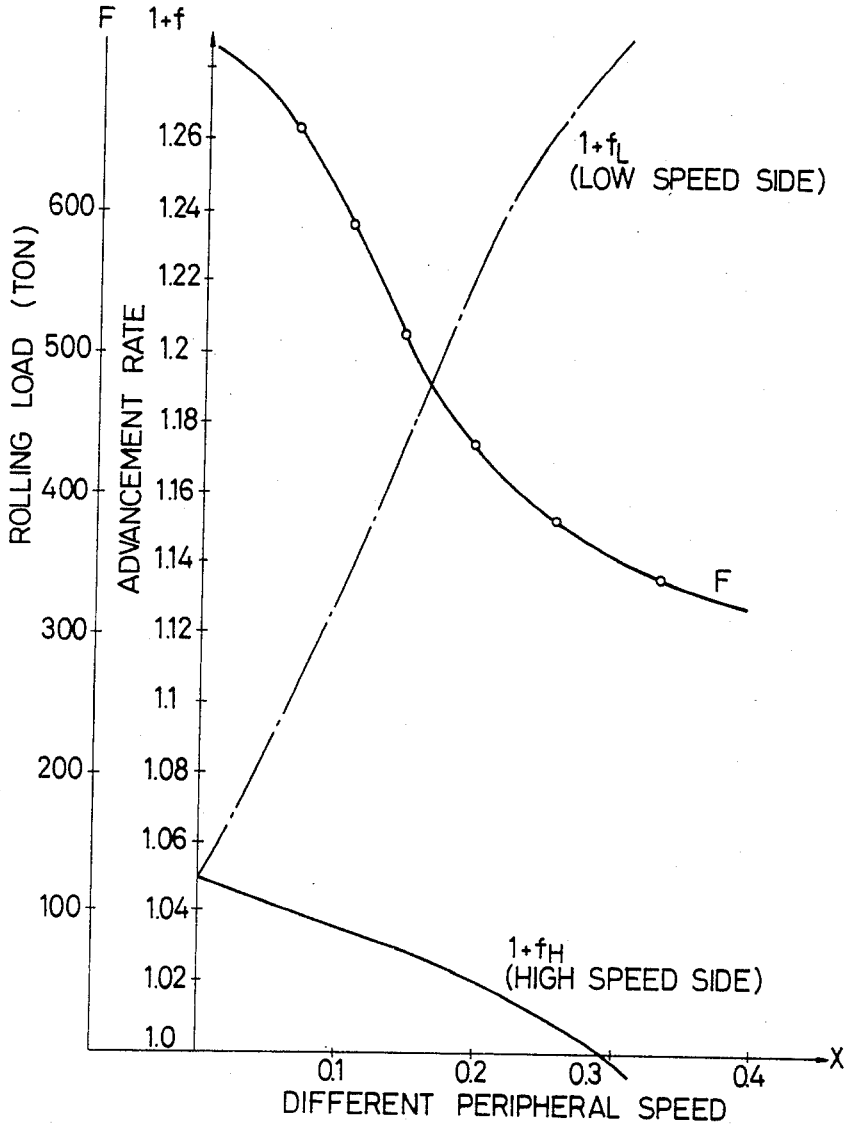
FIG. 3 is a graphical representation showing examples of rolling loads and forward slip of material during different peripheral rolling speeds.

FIG. 3 is a graphical representation of the relationships of different peripheral speed rate, rolling load, and different advancement rates. FIG. 3 shows that a rolling force can be controlled by changing the peripheral speed rates.

The differential peripheral speed rate X is defined in terms of a high speed side roll having a peripheral speed $V_H$ and a low speed side roll having a speed $V_L$ as:

$$X = \frac{V_H - V_L}{V_H} \tag{6}$$

As the differential peripheral speed rate X changes, the material plastic characteristic is changed. Therefore, a new variable X is inserted in equation (1) such that the force F is redefined as a function of input plate thickness H, output plate thickness h, average deformation resistance K, material plate width W and the differential peripheral speed rate X:

$$F = F(H, h, k, W, X) \tag{7}$$

When equation (7) is subjected to linear expansion near the operating point, then $$\Delta F = \frac{\partial F}{\partial H} \cdot \Delta H + \frac{\partial F}{\partial h} \cdot \Delta h + \frac{\partial F}{\partial k} \cdot \Delta k + \frac{\partial F}{\partial W} \cdot \Delta W + \frac{\partial F}{\partial X} \cdot \Delta X \tag{8}$$

If the roll opening degree S is fixed, then from equation (2) we see that $$\Delta h = \frac{\Delta F}{M} \tag{9}$$

Accordingly, in order to eliminate the plate thickness deviation $\Delta h$, from equation (9) $\Delta F$ should be reduced to zero. Rearranging terms from equation (8):

$$\Delta X = -\frac{1}{\frac{\partial F}{\partial X}}\left(\frac{\partial F}{\partial H} \cdot \Delta H + \frac{\partial F}{\partial h} \cdot \Delta h + \frac{\Delta F}{\partial k} \cdot \Delta k + \frac{\partial F}{\partial W} \cdot \Delta W\right) \tag{10}$$

Since the data in the parentheses of equation (10) represents the above-described rolling force variation, equation (9) can be rewritten as $$\Delta X = -\frac{1}{\frac{\partial F}{\partial X}} \cdot \Delta F_D \tag{11}$$

Thus, it is apparent that the plate thickness deviation $\Delta h$ can be zeroed by controlling the differential peripheral speed rate $\Delta X$.

Figure 4:
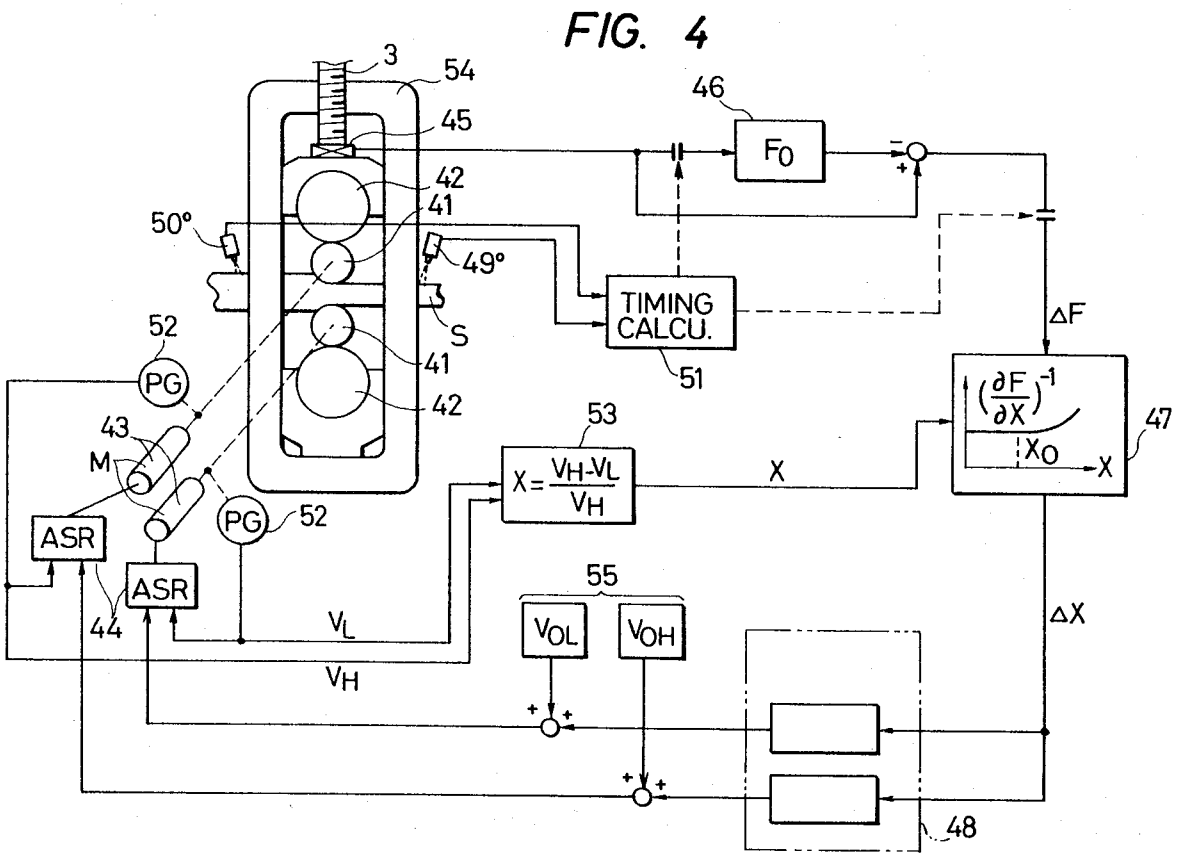
FIG. 4 is a block diagram of the preferred embodiment of the invention.

An embodiment of the invention will now be described with reference to FIG. 4. In FIG. 4, rolling mill 54 has top and bottom work rolls 41 which contact upper and lower backup rolls 42. Electric motors 43 for driving the top and bottom rolls are controlled via speed control units 44. A load cell 45 measures the force imparted by the depressing screw 3. A memory unit 46 receives a signal from load cell 46. A gain adjusting block 47 produces a signal which is sent to a different peripheral speed distributor 48 for the upper and lower rolls. Detectors 49 and 50 detect the presence of of rolling material and send signals to a timing calculator 51. Upper and lower roll speed detectors 52 produce speed signals which are sent to a differential peripheral speed rate calculator 53. Finally, reference numeral 55 denotes an initial speed setting unit for the upper and lower rolling rolls.

The operation of the automatic plate thickness control device of FIG. 4 will now be described. When the material S comes near rolling mill 54, the speeds of the upper and lower rolls are set to speeds $V_{OH}$ and $V_{OL}$, respectively, which define a predetermined initial differential peripheral speed rate $X_O$ where:

$$X_O = \frac{V_{OH} - V_{OL}}{V_{OH}} \tag{12}$$

When the leading end of the material S reaches the detector 49 on the output side of the rolling mill, the rolling load Fo at that time instant is stored in the memory unit 46. When the material S is subjected to an external disturbance such as an input material thickness variation, the load variation $\Delta F = F - Fo$ is detected and applied to the gain adjusting block 47. In the gain adjusting block 47, values $(\delta F^{-1}/\delta X)$ determined by the rolling pass schedules programmed therein. The optimum value of the gain correction curve $\delta F/\delta F^{-1}$ can be obtained according to the rolling pass schedules, and consequently dependent on the variables such as the input thickness, the output material thickness, the kind of steel being rolled, etc. When the gain adjusting block 47 outputs differential peripheral speed rate correction $\Delta X$, the differential peripheral speed distributor 48 determines the upper and lower roll speed correcting value, so that the upper and lower roll speeds are corrected by the upper and lower roll speed control units 44. The differential peripheral speed distributor 48 operates to change the differential peripheral speed with the rolling mill output speed of the material S being maintained at a predetermined value.

The rolling mill output speed $V_S$ of the material S relates to the speeds $V_H$ and $V_L$ of the work rolls on the high and low speed sides as follows:

$$V_S = (1+f_H)V_H = (1+f_L)V_L \tag{13}$$

In order to maintain the material speed $V_S$ at a constant value, $$\Delta f_H \cdot V_{OH} + (1+f_H)\Delta V_H = 0, \text{ and} \tag{14}$$

$$\Delta f_L \cdot V_{OL} + (1+f_L)\Delta V_L = 0. \tag{15}$$

As is apparent from FIG. 3, the forward slip depends upon the differential peripheral speed rate X. Therefore, the linear variations $Wf_H$ and $Wf_L$ can be expressed as:

$$\Delta f_H = \frac{\delta f_H}{\delta X} \cdot \Delta X \tag{16}$$

-continued $$\Delta f_L = \frac{\delta f_L}{\delta X} \cdot \Delta X \tag{17}$$

As can be seen from equations (14) through (17), by correcting $V_H$ and $V_L$, satisfying the equation (18) and (19) the differential peripheral speed rate can be corrected with the strip speed maintained unchanged.

$$\Delta V_H = -\frac{1}{1+f_H} \cdot \frac{\delta f_H}{\delta X} \cdot V_{OH} \cdot \Delta X \tag{18}$$

$$\Delta V_L = -\frac{1}{1+f_L} \cdot \frac{\delta f_L}{\delta X} \cdot V_{OL} \cdot \Delta X \tag{19}$$

where $V_H$ and $V_L$ are the speeds of the rolls on the high and low speed sides, respectively, $(1+f_H)$ and $(1+f_L)$ are the forward slips of the outgoing material speed with respect to the peripheral speed on the high and low speed sides of the rolls, and $(\delta f_H/\delta X)$ and $(\delta f_L/\delta X)$ are the variations of the forward slips with respect to the differential peripheral speed rate.

With the above-described arrangement, as the rolling force F changes, the differential peripheral speed rate X is adjusted so that the rolling force variation $\Delta F$ is cancelled out. As a result, the rolling force becomes constant, and accordingly, the output plate thickness of the material S is maintained at a constant value. The plate thickness control operation is terminated when the tail end of the material S is served by the detector 50.

In the above-described embodiment, rolling load is utilized as a means for detecting the delivery material thickness deviation. However, a thickness gauge may be provided on the delivery side of the rolling mill, so that the output signal of the gauge can be utilized as the detecting means. In other words, any one of a number of known detecting means may be employed in the invention.

As is apparent from the above description, according to the invention, the rolling load variation is minimized by adjusting the differential peripheral speed, such that the AGC can be carried out without adversely affecting the shape qualities of the products. Furthermore, since the control system is of the feedback type, there is no control residuum (i.e., thickness deviation) due to the mill constant estimation error in the BISRA AGC. Accordingly, the AGC is considerably more effective in improving the plate thickness and shape accuracies of the products. The use of the AGC according to this system makes it possible to apply the AGC at the final stand in a hot strip mill, and also eliminates the shape adjusting pass it used in a plate mill.

I claim:

1. In a rolling mill of the type comprising upper and lower rollers between which a rolling material is compressed by a rolling load F, said upper and lower rollers rotating at speeds $V_H$ and $V_L$, respectively, an automatic plate thickness control device comprising:

means for storing an initial value Fo of said rolling load F;

means for detecting a load variation $\Delta F = F - Fo$ and producing it as a deviation load signal $\Delta F$;

means for sensing differential peripheral speed rate X, wherein $$X = \frac{V_H - V_L}{V_H};$$

means for computing a correcting differential peripheral speed rate ΔX as a function of said deviation load signal ΔF and said differential peripheral speed rate X; and means for correcting said speeds $V_H$ and $V_L$ of said upper and lower rollers, respectively, as a function of said correcting differential peripheral speed rate ΔX.

2. The automatic plate thickness control device as recited in claim 1, wherein said means for computing said correcting differential peripheral speed rate ΔX receives both a signal indicative of said differential peripheral speed rate X and said deviation load signal ΔF, and computes the correcting differential peripheral speed rate ΔX as a function of the equation:

$$\Delta X = -\left(\frac{\delta F}{\delta X}\right)^{-1} (\Delta F).$$

3. The automatic plate thickness control device as recited in claim 2, wherein values of $(\delta F^{-1}/\delta X)$ are determined as a function of plate thickness and plate composition.

4. The automatic plate thickness control device as recited in claim 1, wherein said means for correcting said speeds $V_H$ and $V_L$ of said upper and lower rollers, respectively, further comprises a differential peripheral speed distributor producing first and second speed correcting signals; a first storage means for storing in initial speed $V_{OH}$ of said upper roller; a second storage means for an initial storing speed $V_{OL}$ of said lower roller; first adding means for adding said first speed correcting signal to a signal from said first storage means; second adding means for adding said second speed correcting signal to a signal from said second storage means, and first and second speed control units connected to said first and second adding means for varying said speeds $V_H$ and $V_L$ of said upper and lower rollers, respectively.

5. The automatic plate thickness control device as recited in claim 4, wherein said first speed correcting signal $WV_H$ is a function of the equation $$\Delta V_H = -\frac{1}{1+f_H} \cdot \frac{\delta f_H}{\delta X} \cdot V_{OH} \cdot \Delta X$$

and said second speed correcting signal $\Delta V_L$ is a function of the equation $$\Delta V_L = -\frac{1}{1+f_L} \cdot \frac{\delta f_L}{\delta X} \cdot V_{OL} \cdot \Delta X$$

such that said rolling mill material passes through said rolling mill at a speed $V_S$ which is altered by said correction of said speeds $V_H$ and $V_L$ of said upper and lower rollers, respectively.

6. In a rolling mill of the type comprising upper and lower rollers between which a rolling material is compressed by a rolling load F, a method for automatically controlling the thickness of said rolling material, comprising the steps of rotating said upper and lower rollers at different speeds $V_H$ and $V_L$, respectively, to produce a differential peripheral speed rate X defined by the equation $$X = \frac{V_H - V_L}{V_H};$$

detecting a variation in rolling material thickness;

generating a deviation rolling load signal WF as a function of said detection variation;

detecting said differential peripheral rolling speed X;

generating a correcting differential peripheral speed rate signal ΔX as a function of the equation $$\Delta X = -\left(\frac{\partial F}{\partial X}\right)^{-1} (\Delta F);$$

and correcting said speeds $V_H$ and $V_L$ of said upper and lower rollers, respectively, as a function of said correcting differential peripheral speed rate signal ΔX.

* * * * *